United States Patent [19]

Norberg et al.

[11] Patent Number: 4,476,985

[45] Date of Patent: Oct. 16, 1984

[54] SCREW AND BOLT TRAY DISPLAYER

[75] Inventors: Richard A. Norberg; Ronald L. Selin, both of Rockford, Ill.

[73] Assignee: Rockford Products Corporation, Rockford, Ill.

[21] Appl. No.: 264,881

[22] Filed: May 18, 1981

[51] Int. Cl.[3] ..... A97F 3/14

[52] U.S. Cl. ..... 211/126; 211/184; 108/97; D6/468; D6/510; D6/476

[58] Field of Search ..... 211/126, 128, 184; 108/65, 97, 92; 206/561; 220/22.1; D6/199, 188, 189; D9/456, 424, 341

[56] References Cited

U.S. PATENT DOCUMENTS

| | | | |
|---|---|---|---|
| D. 207,564 | 5/1967 | Hartford | D6/188 |
| 1,739,730 | 12/1929 | Orthwine | 211/184 |
| 1,958,520 | 5/1934 | Morton et al. | 211/128 |
| 1,990,398 | 2/1935 | Beddingfield | 211/126 X |
| 2,309,896 | 2/1943 | Gustafson et al. | 211/184 X |
| 2,483,769 | 10/1949 | Hickey | 211/184 X |
| 2,935,209 | 5/1960 | Fritz | 108/97 X |
| 3,581,906 | 6/1971 | Joyce | 211/126 |
| 3,638,587 | 2/1972 | Uyeda | 108/97 X |
| 4,138,015 | 2/1979 | Rabley | 211/126 X |

*Primary Examiner*—William E. Lyddane
*Assistant Examiner*—Peter A. Aschenbrenner

[57] ABSTRACT

An integrally formed display tray having forward and rear compartments for placement on existing shelving in a retail store. The forward compartment is connected to the rear compartment in depending fashion to overhang the shelf. Dividers may be placed in aligned pairs of vertical slots to segregate the products in the tray.

5 Claims, 4 Drawing Figures

SCREW AND BOLT TRAY DISPLAYER

BACKGROUND OF THE INVENTION

The present invention relates to trays of the type used to display loose items such as individual screws and bolts and more particularly to such trays that are capable of being placed on existing retail store shelves.

Existing displays for small loose pieces such as screws, bolts and nuts typically consist of separate, free standing racks that are placed in retail stores. From the retailers point of view these racks are quite often unacceptable because they require additional floor space and frequently do not complement the existing overall appearance of the store.

Accordingly, it would be desirable to provide displays that accommodate existing space in retail stores. More particularly, a display tray that could be placed on existing shelving would be most advantageous. It is also preferable to provide a display tray that would be capable of storing both packaged and loose products.

SUMMARY OF THE INVENTION

The display tray of the present invention is constructed to be positioned on existing shelving in retail stores. The tray includes an integrally molded or formed member defining forward and rear compartments. The forward compartment extends from the front wall of the rear compartment in depending fashion and is adapted to overhang the front edge of a shelf. Preferably, the rear compartment is larger than the forward compartment and has a generally flat bottom portion to hold products packaged in boxes. The forward compartment may have a generally rectangular cross-section defined by front and back inner walls. The back wall portion has a plurality of spaced vertical slots therein aligned with a similar plurality of spaced vertical slots in the front wall portion to accommodate dividers positioned between aligned pairs of slots for separating different piece stock.

A one-piece divider is provided which comprises front and rear portions contoured to fit into the forward and rear compartments of the display tray. The back portion of the divider terminates in a hook that engages the outer back wall of the rear compartment while the into front portion fits into aligned pairs of vertical slots in the forward compartment. Use of the one-piece divider obviates the need for aligned pairs of vertical slots in the rear compartment walls and reduces the number of individual parts required in the display tray.

The outer front wall portion of at least the forward compartment may be provided with a sloped surface onto which markers, tags or other means of identifying the displayed products can be placed so that customers can readily identify and locate the particular product being sought. Alternatively, a separate strip into which identification markers can be place may be fastened to the outer front wall portion of the forward compartment.

BRIEF DESCRIPTION OF THE DRAWINGS

FIG. 3 is a perspective view of another embodiment of the present invention.

FIG. 4 is a cross sectional view taken along line 4—4 of FIG. 3.

DESCRIPTION OF THE PREFERRED EMBODIMENT

Figure 1:
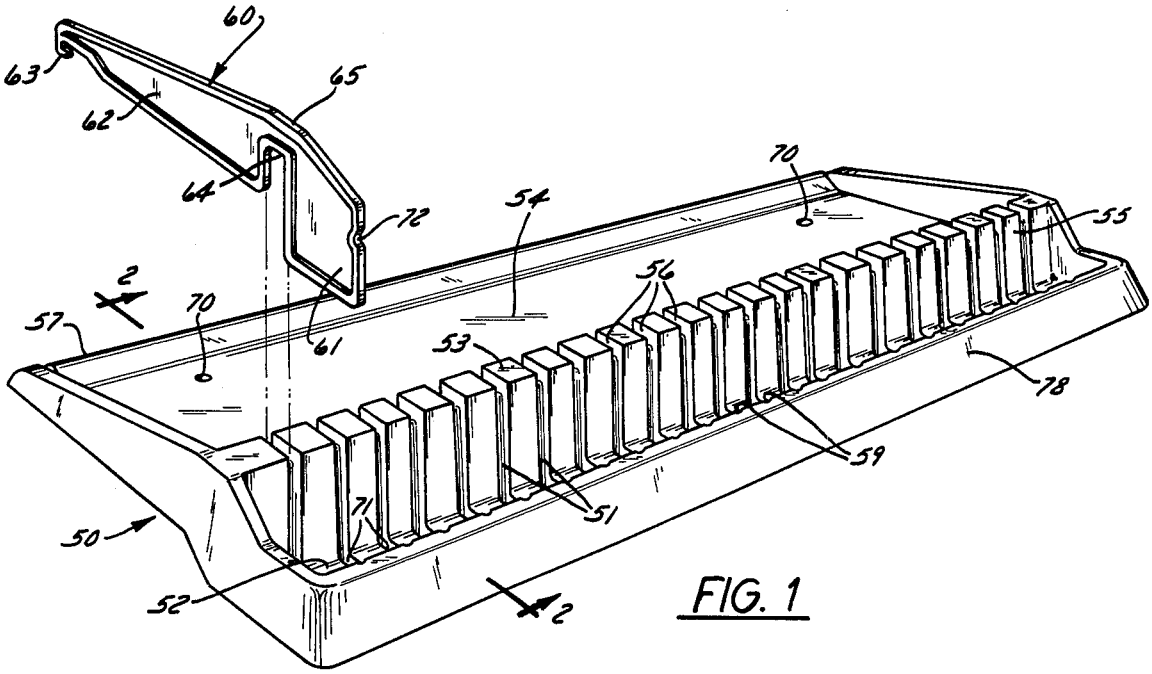
FIG. 1 is a perspective view of a display tray constructed in accordance with the principles of the present invention.
Figure 2:
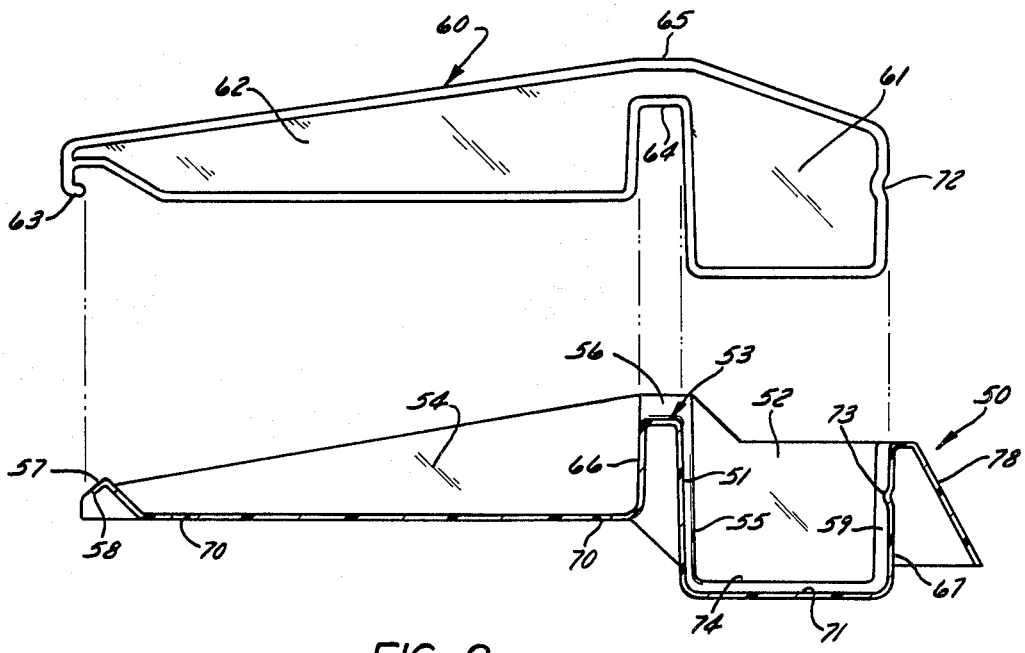
FIG. 2 is a cross-sectional view taken along line 2—2 of FIG. 1.

Referring now to FIGS. 1 and 2, the display tray 50 of the present invention includes an integrally molded or formed member defining forward 52 and rear 54 compartments joined by an intermediate partition 53. The intermediate partition 53 is formed as a downwardly opening channel having a front side 55 and a back side 66. The surface area of the bottom portion of the rear compartment 54 is substantially larger than that of the forward compartment 52 so that packaged stock can be stored in the rear compartment 14 while loose piece stock can be stored in the forward compartment 12. The forward compartment 52 has a generally flat bottom floor 74 and generally resembles a rectangle in cross-section and is broad enough in its front-to-back dimension to permit customers to relatively easily select the quantity of loose piece stock desired.

The forward compartment 52 depends from the intermediate partition 53 so that it will extend over and beyond the edge of a conventional shelf. The outer front wall 78 of the forward compartment 52 includes an which preferably slopes back at an angle from the vertical so that markers, tags or other identification means can be applied to the outer front wall 78 where they can be easily read by customers.

The present embodiment differs from that shown in FIGS. 1 and 2 in that the forward compartment 52 has a more generally rectangular cross-section although it may have the previously discussed curved U-shape as well. The intermediate partition 53 joining the forward 52 and rear 54 compartments has top slots 56 and contiguous front slots 51 in the front side 55 thereof, and the inner front wall 67 of the front compartment 52 has a series of vertical slots 59 aligned with the slots 51, and the bottom floor 74 has horizontal slots 71 connecting aligned slots 51 and 59 for receiving a one-piece divider 60. The divider 60 includes front 61 and back 62 portions each respectively contoured to fit into the forward 52 and rear 54 compartments of the display tray 50. The back portion 62 of the divider 60 terminates in a hook 63 that engages the outer back wall 57 of the rear compartment 54 which has a lip 58 that fits into the hook 63. The front portion 61 of the divider 60 is contoured to fit into the vertical slots 51, 59 and into the top slots 56 of the intermediate partition 53 in mating engagement to provide for separation of loose piece stock stored therein. Indentation 72 in the front edge of divider 60 is adapted to mate with a dimple 73 in the slot 59 to help secure divider 60 in its seated position. A slot 64 is positioned in the central portion 65 between the front 61 and back 62 portions of the divider 60 to define a notch dimensioned to engage the slots 51 and 56 in the intermediate partition 53 and rear 54 compartments.

There is thus provided a display tray 50 with a plurality of one-piece dividers 60 for separating both forward 52 and rear 54 compartments which can be secured to existing shelving by inserting threaded fasteners through a plurality of suitably positioned mounting holes 70 in the bottom portion of the rear compartment 54, and aligned holes in the shelf onto which the tray 50 is placed.

Although the display tray of the present invention has been described with particular reference to the embodiment shown, it will be apparent to those skilled in the art that variations and modifications may be made without departing from the scope of the invention as defined by the following claims.

What is claimed is:

1. A display tray for attachment to shelving comprising an integrally formed member defining forward and rear compartments; said rear compartment comprising front, rear and side walls in the general form of a rectangle; an intermediate partition between and connecting said forward and rear compartments, said intermediate partition being in the form of an inverted channel having a front side and a back side, said forward compartment connected to said rear compartment in extending depending fashion and comprising front, rear and side inner walls in the general form of a rectangle, said forward compartment rear inner wall being formed by said intermediate partition front side; said intermediate partition having a plurality of horizontally spaced vertical slots; said inner front wall of said forward compartment having a like plurality of spaced vertical slots generally aligned with the slots in said intermediate partition; a plurality of dividers disposed in aligned pairs of said slots, wherein said dividers each comprise a front portion having a contour substantially the same as the inner contour of said forward compartment and dimensioned to fit into aligned pairs of said slots in said front wall of said forward compartment and in said intermediate partition, a back portion having a contour substantially the same as the inner contour of said rear compartment, connecting means integral with said back portion for attaching said back portion to said rear wall of said rear compartment, and a central portion connecting said front and back portions, which central portion defines a notch engageable with said intermediate partition; and means integral with said tray for securing said tray to a shelf.

2. A display tray as defined in claim 1 wherein said connecting means of said divider comprises a hook portion engageable with the back wall of said rear compartment.

3. A display tray as defined in claim 2 wherein said divider has an indentation in its front edge and said inner front wall of said forward compartment includes a dimple adapted to mate with said indentation.

4. A display tray for shelving as defined in claim 1 wherein said rear compartment has a substantially greater horizontal surface area than said forward compartment.

5. A display tray for shelving as defined in claim 1 wherein said forward compartment is connected to said rear compartment in extendingly depending fashion such that said forward compartment is able to extend beyond connecting shelving and said front wall of said forward compartment further includes and outer front wall connected to the top of said front inner wall and tapered back from vertical to receive product identification means.

* * * * *